US010879017B2

(12) United States Patent
Haake et al.

(10) Patent No.: US 10,879,017 B2
(45) Date of Patent: Dec. 29, 2020

(54) CLOSING-EDGE SAFETY DEVICE WITH PRECHAMBER

(71) Applicants: André Haake, Stadtlohn (DE); Oliver Haake, Stadtlohn (DE); Patrick Haake, Vreden (DE)

(72) Inventors: André Haake, Stadtlohn (DE); Oliver Haake, Stadtlohn (DE); Patrick Haake, Vreden (DE)

( * ) Notice: Subject to any disclaimer, the term of this patent is extended or adjusted under 35 U.S.C. 154(b) by 0 days.

(21) Appl. No.: 16/271,041

(22) Filed: Feb. 8, 2019

(65) Prior Publication Data

US 2019/0172659 A1 Jun. 6, 2019

Related U.S. Application Data

(63) Continuation of application No. PCT/EP2017/070434, filed on Aug. 11, 2017.

(30) Foreign Application Priority Data

Aug. 11, 2016 (DE) ..... 10 2016 114 886

(51) Int. Cl.
*H01H 3/16* (2006.01)
*H01H 3/14* (2006.01)
*E05F 15/44* (2015.01)

(52) U.S. Cl.
CPC ..... *H01H 3/161* (2013.01); *E05F 15/44* (2015.01); *H01H 3/142* (2013.01);
(Continued)

(58) Field of Classification Search
CPC ..... H01H 3/161; H01H 2003/165; H01H 2221/05; H01H 2225/012; H01H 3/142; E05F 15/44; E05F 15/42
(Continued)

(56) References Cited

U.S. PATENT DOCUMENTS 3,321,592 A * 5/1967 Miller ..... B66B 13/26 200/61.43
4,519,474 A * 5/1985 Iseli ..... B60J 10/00 180/277

(Continued)

FOREIGN PATENT DOCUMENTS

DE 29808292 U1 7/1998
DE 29905816 U1 3/2000

(Continued)

OTHER PUBLICATIONS

Translation DE102010035692 (Original doc.published Mar. 1, 2012) (Year: 2012).*

(Continued)

*Primary Examiner* — William A Bolton
(74) *Attorney, Agent, or Firm* — Jeffrey Joyce, esq.

(57) ABSTRACT

A closing edge safety device that triggers a safety response upon contact with an obstacle. The body of the safety device is an elastically deformable profile element that encloses a switch chamber containing a switching strip that carries an electrical current. A prechamber with a switching nub is placed at the leading edge of the safety device, in front of the switch chamber. When an external force is applied to the leading edge of the safety device, the switching nub transmits the force to the switch chamber, which also deforms, causing an interruption in the electrical current on the switching strip, thereby triggering the desired safety response of the closing edge safety device. The closing edge safety device provides improved response to large-area as well as small-area contact with an obstacle and is also suitable for use as a limit switch.

9 Claims, 3 Drawing Sheets

(52) U.S. Cl.
CPC ... *H01H 2003/165* (2013.01); *H01H 2221/05* (2013.01); *H01H 2225/012* (2013.01)

(58) Field of Classification Search
USPC ..... 200/47, 61.44, 61.43, 61.23, 329, 61.81, 200/85 R, 86 R
See application file for complete search history.

(56) References Cited

U.S. PATENT DOCUMENTS

| | | | | |
|---|---|---|---|---|
| 4,532,388 | A | 7/1985 | Sackmann | |
| 5,072,080 | A * | 12/1991 | Beckhausen | B60J 10/00 200/61.43 |
| 6,740,826 | B1 * | 5/2004 | Friedrich | H01H 3/142 200/61.43 |
| 9,279,281 | B2 * | 3/2016 | Miller | E05F 15/44 |
| 2001/0013203 | A1 * | 8/2001 | Griesbach | B60J 10/00 49/440 |

FOREIGN PATENT DOCUMENTS

| | | | |
|---|---|---|---|
| EP | 1063380 | A2 | 12/2000 |
| EP | 1310624 | | 5/2003 |
| WO | 2012025198 | A1 | 3/2012 |

OTHER PUBLICATIONS

Translation DE29808292 (Original doc. published Jul. 23, 1998) (Year: 1998).*

* cited by examiner

CLOSING-EDGE SAFETY DEVICE WITH PRECHAMBER

BACKGROUND INFORMATION

Field of the Invention

The invention relates to a closing edge safety device that interrupts flow of electrical current on a switching strip upon contact with an obstacle, thereby triggering the desired safety response of the closing edge safety device.

Discussion of Prior Art

German Utility Model DE 299 05 816 U1A discloses a generic closing edge safety device. The safety switching strip has a plurality of contact elements, whereby the contact between the contact elements is interrupted when the switching strip undergoes a locally limited deformation. The elastically deformable profile element that houses the switching strip provides a robust, long-lasting protection for the switching strip and, due to its elastic deformability, enables the desired safety response to be triggered when the current flow on the switching strip is interrupted as a result of contact with an obstacle, yet also allows the profile element to return to its original state after making contact with an obstacle that causes the deformation. Because of this ability to return to its original shape, the closing edge safety device maintains its original appearance over a long service life.

Use of the generic closing edge safety device is usually limited to safety-relevant applications. It is used, for example, particularly to protect humans against pinching, whereby a person's limb, i.e., an arm, when it comes into contact against the safety device, causes sufficient deformation to trigger the desired interruption of the contact elements and, thus, the flow of current through the switching strip.

In contrast to a locally limited deformation that results in a triggering the switching strip, a large-area contact on conventional closing edge safety devices usually does not trigger the switching strip. For this reason, the conventional closing edge safety device cannot be used as a limit switch, which device typically trigger a switching operation when, for example, the object the safety device is mounted on reaches its end position and makes contact with a large-area object, such as a door frame, or a floor, etc. Even a large-area contact with a body, especially if the body is relatively soft and yields under pressure, often does not trigger the safety response, i.e., does not trip the switching strip sufficiently to result in an interruption of current flow.

German Utility Model DE 298 08 292 U1 discloses a switching strip that operates on the normally open (NO) principle, i.e., the contacts close when the switching strip is actuated. Actuation can either occur pointwise or over a large area and always leads to a triggering of the switching strip. In such an embodiment that is intended to respond to large-area actuation, individually mounted switching nubs are not used to optimize the response of the safety edge to large-area actuation, but instead, profile webs that extend over the entire length of the profile. Use of these extended webs ensures that the applied force is transmitted across the contact surfaces, instead of just at the specific points of applied force.

German Utility Model DE 20 2014 001 722 U1 discloses the use of switching nubs. In that disclosure, switching nubs are provided on the inner surface of a comparatively rigid impact element, wherein a switching strip or switching mat is provided directly behind the impact element, i.e., adjacent the switching nubs.

What is needed is a closing edge safety device that provides the desired reliability, durability, long service life. What is further needed is such a closing edge safety device that high response sensitivity over a wide angular range of the leading edge of the closing edge safety device. What is yet further needed is such a safety device that is not limited to use as a closing edge safety device, but can also be used as a limit switch.

BRIEF SUMMARY OF THE INVENTION

The invention is a closing edge safety device that responds with improved sensitivity when making contact with an obstacle, yet has a robust, durable design that ensures long and reliable service life. The body or housing of the closing edge safety device according to the invention is a profile element formed from a deformable elastomeric material that forms and encloses, among other things, a switch chamber that contains a switching strip and a prechamber that contains an actuator for the tripping the switching strip. This prechamber is placed in front of the switch chamber, i.e., on the leading edge of the safety device. The closing edge safety device is mounted on a surface of the equipment or device to be safeguarded, i.e., a surface that will make initial contact with an obstacle, and extends the length of the surface to be safeguarded. When the safety device encounters an obstacle, the obstacle causes the housing to deform, thereby pressing the actuator against the switch chamber, which in turn deforms and causes the switch elements of the switching strip to pull apart or be displaced, thereby interrupting the flow of electric through the switching strip, which interruption triggers the safety response.

The actuator in the prechamber is a nub, i.e., knob- or button-like element, referred to hereinafter as a switching nub. The switch nub is a spatially limited device, but even when the closing edge safety device comes into contact with a large-area obstacle, such as a wall surface, floor surface, or the like, the pressure that is applied to this spatially limited device is transmitted to the switch chamber, which, as described above, results in a triggering of the desired safety response.

The switching nubs are located outside of the switch chamber, but enclosed in the prechamber, so that the outer surface of the profile element is an uninterrupted, smooth surface. This also means that the switching nubs are hidden from view, which makes for an optically aesthetically pleasing design of the closing edge safety device. A further advantage of enclosing the switching nubs in this prechamber is that the nubs are protected against mechanical influences, such as abrasion or shearing, and against contaminants in general and/or moisture. This protection against external influences is important to maintain a long and reliable service life, particularly if the switching nubs are adhesively mounted in the safety device, which would make them particularly vulnerable to shear forces.

The closing edge safety device according to the invention provides improved response sensitivity. The safety device is reliably triggered, even when contact is with a comparatively soft obstacle that exerts a large-area contact on the safety device. In conventional safety devices, large-area contact with an obstacle can possibly prevent triggering of the safety device. The safety device according to the invention results in improved safety, for example, for persons handling or working around movable equipment.

The safety device is also suitable for use beyond purely safety-related applications, such as, for example, use as a limit switch. Reaching a specified limit position reliably results in a triggering of a switching operation. For example, if a gate is moved to make contact with a large-area obstacle, such as a frame or the floor, the switching operation then turns off the drive means that drives the movable element of the gate. The closing edge safety device according to the invention is able to be designed to effectively contain so-called overtravel, i.e., the distance that a device still travels after the stop signal and that presents a hazard.

Several switching nubs may be distributed over the length of the profile element in the prechamber. In this way, when the closing edge safety device makes either a large-area, i.e., wide contact, or a small-area, i.e., narrow contact against an object, the pressure transmitted by the switching nubs to the switch chamber will reliably trigger the switching operation. Thus, for example, if the intended use of the closing edge safety device according to the invention is to ensure personal safety and the overall length of the closing edge safety device is several meters, switching nubs may be spaced apart in the prechamber, for example, placed 20 to 30 cm apart. When contact is made with a soft obstacle, such as a human torso, at any point along the leading edge of the closing edge safety device, the deformation at the place of contact reliably triggers the desired switching operation.

In addition to providing the prechamber at the leading edge of the closing edge safety device, two or more prechambers may also be provided along the upper sides of the closing edge safety device, so that the plurality of prechambers are adjacent to a greater circumferential area surrounding the switch chamber. Depending on the intended use of the closing edge safety device, at least two of the prechambers contain switching nubs. This configuration of prechambers further improves the sensitivity of the closing edge safety device, because the switching operation is triggered when contact is made from a lateral direction, as well as at the leading edge.

In an embodiment with more than one prechamber the additional prechambers need to be provided between the outer wall of the profile element at the leading edge and the wall that forms the switch chamber. An embodiment of the closing edge safety device according to the invention that is particularly advantageous includes three prechambers, a central one provided between the leading edge of the safety device and the switch chamber and a prechamber below and to each side of the central prechamber, so that the three prechambers surround the upper circumference of the switch chamber. This configuration ensures a sensitive response of the safety device when contact is made at any point in a relatively large angular area that surrounds an upper portion of the switch chamber.

Depending on the application, it is possible that switching nubs are not be provided in all prechambers, but rather, a closing edge safety device according to the invention having a plurality of prechambers may be constructed to accommodate combinations of different types of closing edge safety devices. In this case, a similar profile element may be used to accommodate various possible configurations, and, again, depending on the particular application, the prechambers may be equipped differently with switching nubs, for example, one or more or all prechambers may be provided with switching nubs.

The switching nubs may be prefabricated elements, but it is also possible to create the switching nubs directly in the prechamber. For this purpose, a flowable, curable, or cross-linkable material is injected into the prechamber at the desired location for the switching nub and subsequently solidifies in the prechamber, creating the switching nub. There are many suitable types of flowable material that cure and solidify and that are suitable for this purpose. An example of one type of material is a thermally liquefied material that is commercially available, for example, a hot melt adhesive. Another example is a two-component material which hardens in a specifiable pot life.

The flowable material may be injected into the prechamber by means of, for example, a cannula, i.e., a needle, which pierces through the outer sheath of the profile element into the prechamber. A switching nub may be attached in this way to the prechamber, without any pretreatment of the profile element at arbitrary locations. Alternatively, a through-hole may be provided through the wall of the profile element to provide a pathway that allows a needle or small tube to feed the flowable material into the prechamber. In this way, even highly viscous liquids may be injected easily into the prechamber, by means of needles or tubes having the appropriate diameters.

It is possible to avoid creating a break, i.e., the through-hole, in the leading edge on the profile element by providing the through-hole on the first side, i.e., the mounting surface, of the safety device. This mounting surface is the face of the closing edge safety device that is mounted against a fixture, piece of equipment, or installation and, thus, a break in the surface on this face of the profile element will be covered by the surface on which the safety device is mounted. This second avenue of gaining access to the prechamber leaves the leading edge of the closing edge safety device intact. The uninterrupted surface of the profile element is aesthetically advantageous, reduces the risk of damage or contamination to this leading edge, and also allows the profile element to be cleaned very easily.

As mentioned above, the switching nub may be provided as a prefabricated component, instead of being created in situ in the prechamber. The shape of the nub may be designed to correspond to the free inner cross section of the prechamber, so that the switching nub fits flush within the inner contour of the prechamber. It may be economically advantageous, however, to use a switching nub that is available as a commercially available prefabricated element, for example, in the form of a ball, or the like. A guide element may be used to position the prefabricated switching nub in the prechamber. The guide element may be, for example, a thin flat metal strip, a wire, or a cord, any construction that allows the desired number of switching nubs to be attached to it and that is then able to be threaded through the prechamber to place the switching nubs at the desired locations along the length of the profile element. The guide element may extend over the entire length of the prechamber.

One advantage of using a guide element that extends the entire length of the prechamber is that the positions of individual switching nubs may be fixed at desired locations and prevented from shifting away from these locations. For example, the two ends of the guide element may be attached to respective end caps that are used to close off the openings at the two ends of the prechamber. Fixing the guide element to the end caps means that the guide element is fixed in its position within the prechamber once the end caps are put in place. A potting or grouting compound may be used to form the end caps, whereby the ends of the guide element are embedded in the potting compound. The guide element and, thus, any switching nubs mounted on it, are fixed in position when the potting compound has solidified. Alternatively, the two end ecaps may be fittings that are either inserted into the prechamber or glued to the profile element, so that in these cases, too, the two ends of the guide element are fixed in place either by clamping and/or by gluing them, which, of course, fixes the position(s) of any switching nubs mounted on the guide element.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
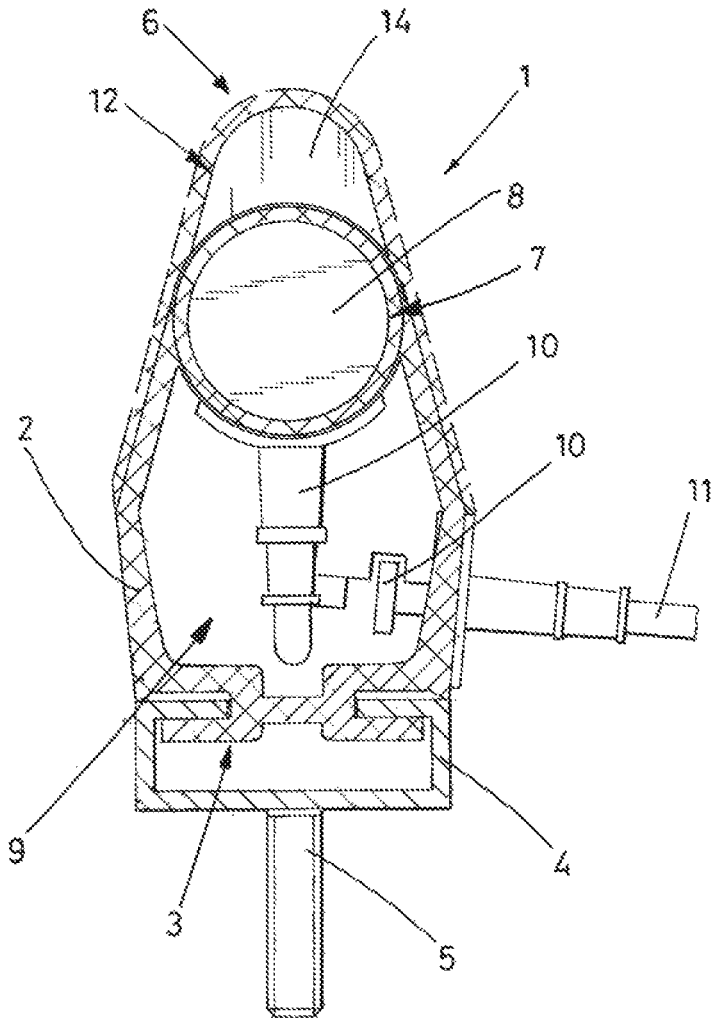
FIG. 1 is a cross-sectional end view of a closing edge safety device according to the invention.

FIG. 1 illustrates a first embodiment of a closing edge safety device 1 according to the invention that comprises a body or housing that is a profile element 2 that encloses a switch chamber 7 that contains a switching strip 8A and a cable 11 that supplies the strip 8A with electrical current, and a prechamber 12 that contains a switching nub 14. The profile element 2 is made of an elastomeric material and has a first side or mounting side 3 and a second side or leading edge 6. The closing edge safety device 1 is conventionally fastened to the equipment or device that requires safeguarding, i.e., a safety stop, by fastening the mounting side 3 to a metal rail 4 that is then mounted along the surface of the equipment or device that requires safeguarding. Fasteners 5, such as bolts, are conventionally used to fasten the closing edge safety device 1 to the equipment. The leading edge 6 of the safety device 1 is the portion of the closing edge safety device 1 that is designed and mounted so as to be the first surface that makes an initial contact with an obstacle when the equipment is moving along its intended path. This leading edge 6 is contact-sensitive, i.e., touch- or pressure-sensitive.

The switching strip 8A that is enclosed within the switch chamber 7 in the profile element 2 is made up of a plurality of switch elements 8, i.e., contact elements, whereby each switch element 8 is in electrically conductive contact with an adjacent contact element 8, so as to form a contact chain. An electric cable 11 that supplies the switching strip 8A with current is enclosed in a protective sheath 10 and is introduced through a wall of the profile element 2 into a deformation space 9 that is provided just below the switch chamber 7. The deformation space 9 allows the profile element 2 to deform when the closing edge safety device 1 makes contact with an obstacle. This deformation changes the shape of the switch chamber 7, thereby causing displacement of one or more of the switch contacts 8 and consequently, interrupting the contact between at least two adjacent contacts 8 in the switching strip 8A, which then triggers the switching operation of the closing edge safety device 1.

Figure 2:
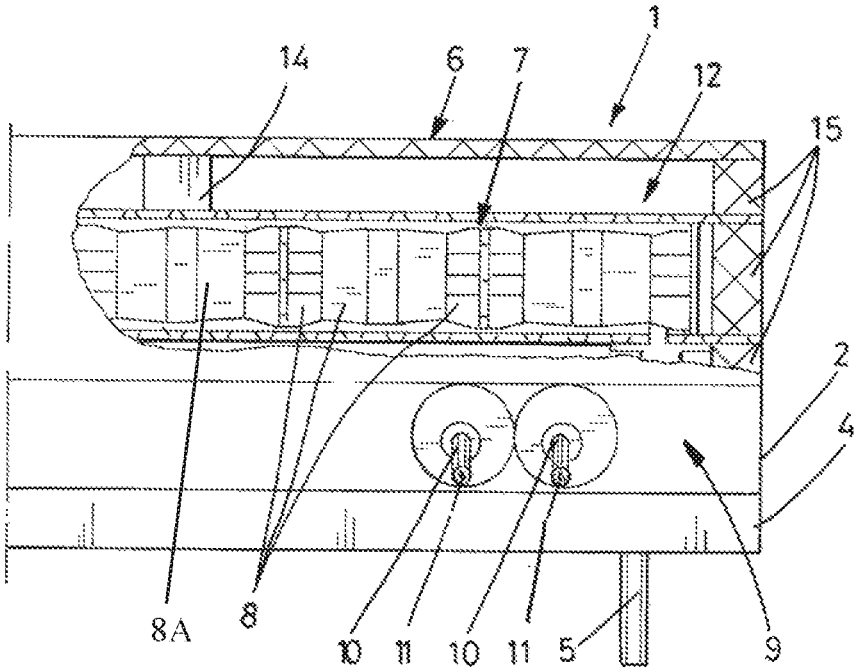
FIG. 2 a partial cut-away side view of the closing edge safety device of FIG. 1, illustrating a switching nub and its relationship to the switch chamber that holds the switching strip.

FIG. 2 is a side view of the closing edge safety device 1 that is mounted on the rail 4 and extends substantially along the length of the surface of the equipment that requires the safeguard. The cut-away portion of the drawing shows in cross-section the switching strip 8A in the switch chamber 7 and the prechamber 12 between the leading edge 6 and the switch chamber 7. The illustration shows a switching nub 14 in the prechamber 12 and, in this embodiment, it is shown as a discrete element that is attached to the upper and lower walls of the prechamber 12. Unlike the switching strip 8A, which extends the entire length of the switch chamber 7, the switching nub 14 may be provided only at discrete intervals along of the length prechamber 12. Although only one switching nub 14 is shown in this illustration, it is understood that a plurality of switching nubs 14 may be provided, spaced apart along the length of the closing edge safety device 1 to ensure the desired high sensitivity response of the safety device 1.

End caps 15 are used to seal off the ends of the prechamber 12, the switch chamber 7, and the deformation space 9, to prevent the ingress of objects, contamination, or moisture into the closing edge safety device 1.

Figure 3:
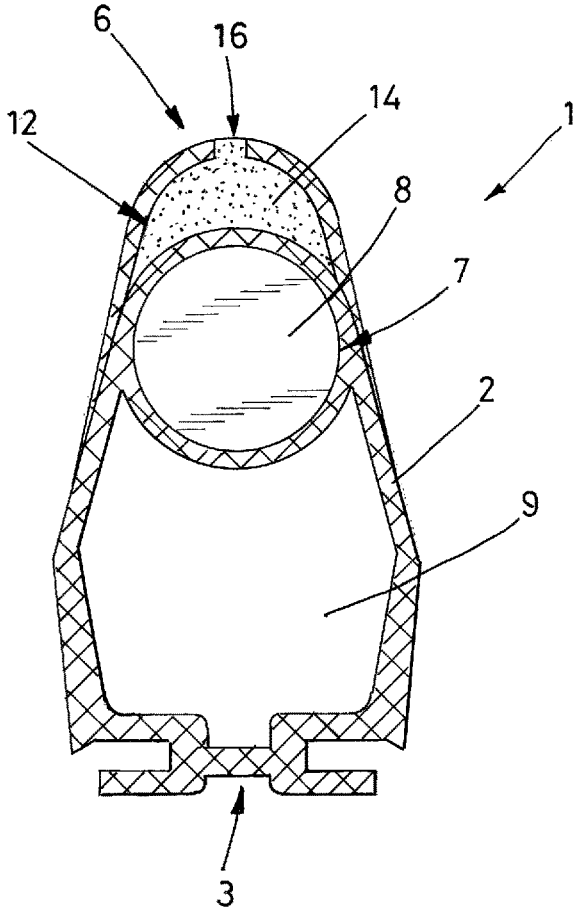
FIG. 3 is a cross-sectional end view of a second embodiment of the closing edge safety device and illustrates a switching nub that is created from a potting compound and filled into the prechamber via a bore through the leading edge of the profile element.

FIG. 3 illustrates a second embodiment of the closing edge safety device 1 according to the invention, showing a cross section of the end view similar to that of FIG. 1. In the embodiment of FIGS. 1 and 2, the switching nub 14 is a precisely formed contour piece, whereas the switching nub 14 in this second embodiment is created from a material that is referred to as a grouting or potting compound and that is initially in a flowable state. The potting compound is filled into the prechamber 12 while it is still in this flowable state and then solidifies in the prechamber 12 to form the switching nub 14. In the embodiment shown, an aperture or through-hole 16 on the second side 6 of the profile element 2 provides a path through which the flowable material is introduced into the prechamber 12. Ideally, the dosage of the material used is such that it also fills the through-hole 16, so that the solidified potting compound on the outer surface of the profile element 2 creates a dense and virtually uninterrupted surface.

It may be desirable to avoid creating a break in the wall of the profile element 2 on the leading edge 6 of the device to inject the potting compound. Alternatively, then, the opening 16 to create a pathway into the prechamber 12 may be done from the mounting side 3. In this case, the opening 16 goes through the base region of the profile element 2 on the mounting side 3 and then through two opposite wall portions of the switch chamber 7; the flowable material is then injected via this pathway into the prechamber 12 to create the switching nub 14. This alternative pathway allows the leading edge 6 of the profile element 2 to remain intact, i.e., completely closed and uninterrupted; the break in the surface of the profile element on the mounting side 3 does not present a problem, because it is covered up when the safety device 1 is mounted on the rail 4 or on the equipment.

Figure 4:
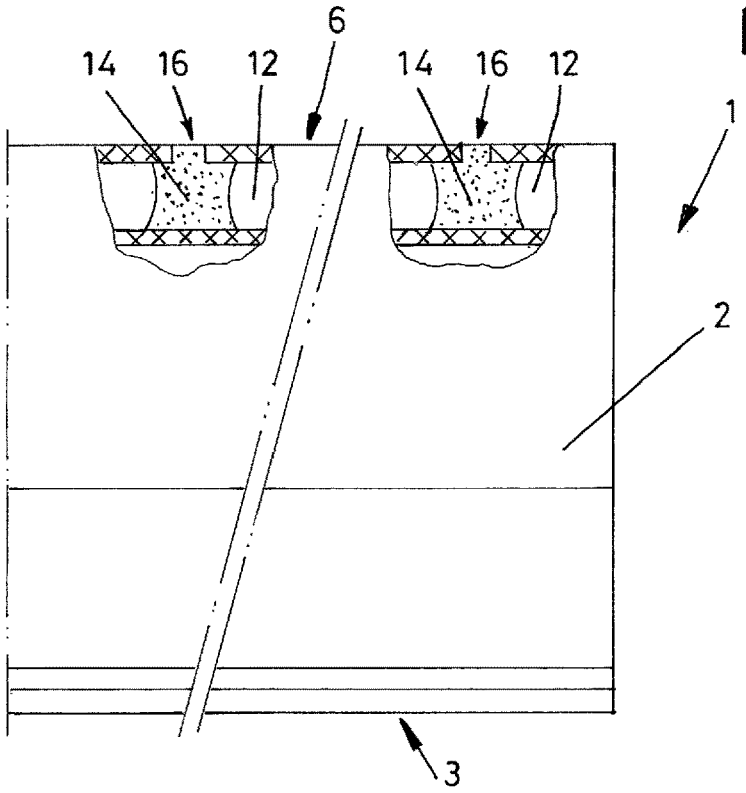
FIG. 4 is a partial cut-away view showing a lengthwise cross-section through the embodiment shown in FIG. 3 and illustrating particularly a switching nub created in situ by injected potting compound.

FIG. 4 shows two partially cut-away cross-sectional views of the closing edge safety device 1 illustrated in FIG. 3, but to a smaller scale than shown in FIG. 3. As previously mentioned, the potting compound solidifies after it has been injected into the prechamber 12 and as it hardens, the volume shrinks. The material has good wall-adhesion and because of this, adheres well to the surfaces that form the upper and lower surfaces of the prechamber 12. As a result, the compound does not shrink evenly over the entire volume, but has greater shrinkage over the middle portion, forming a switching nub 14 that has an hourglass shape.

Figure 5:
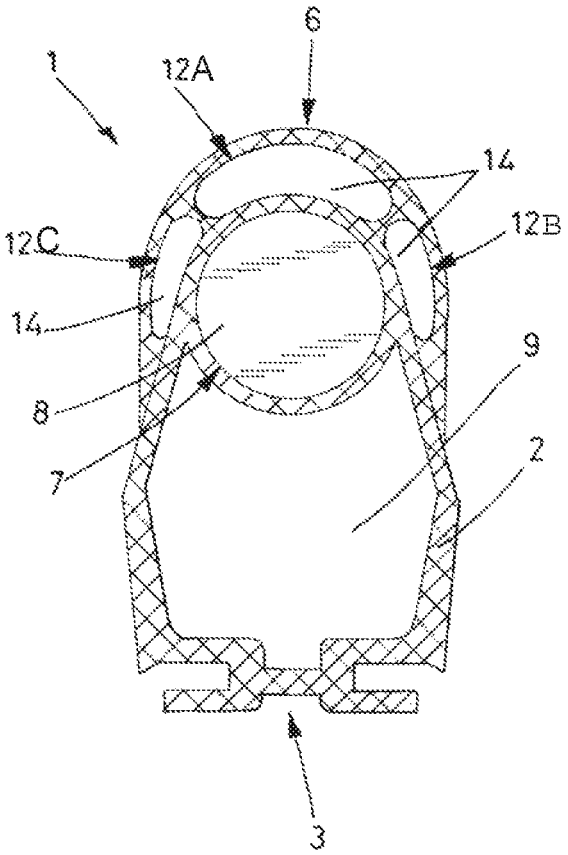
FIG. 5 is a cross-sectional end view through a third embodiment of the closing edge safety device according to the invention, illustrating a closing edge safety device according to the invention having three prechambers.

FIG. 5 illustrates a third embodiment of the closing edge safety device 1 according to the invention, in which the prechamber 12 includes a plurality of such prechambers 12. In the embodiment shown, three prechambers 12 are provided in the area at the leading edge 6 and laterally on both sides of this leading edge. A middle prechamber 12A is directly aligned between the leading edge 6 and an upper portion of the switch chamber 7. Lateral prechambers 12B and 12C are provided on each side between the profile element 2 and an upper circumference of the switch chamber 7. All three prechambers 12 extend substantially the length of the closing edge safety device 1 and switching nubs 14 may be provided in all three prechambers. Overall, the prechambers 12A, B, and C and their switching nubs 14 in this embodiment surround more than half the circumference of the switch chamber 7. This increases the response sensitivity of the closing edge safety device 1 because the switching operation is triggered upon contact with an obstacle not only when the contact is a frontal contact at the leading edge 6, but also is also lateral to the leading edge 6.

It is understood that the embodiments described herein are merely illustrative of the present invention. Variations in the construction of the closing edge safety device may be contemplated by one skilled in the art without limiting the intended scope of the invention herein disclosed and as defined by the following claims.

What is claimed is:

1. A closing edge safety device comprising:

a profile element that is elastically deformable, the profile element having a first side that is mountable on equipment to be safeguarded, a second side that is a leading edge of the closing edge safety device and that is contact-sensitive, and a length that extends along an edge of the equipment;

a switch chamber enclosed within the profile element, the switch chamber containing a switching strip made up of a plurality of contact elements, each contact element being in electrically conductive contact with an adjacent contact element, the switch chamber and the switching strip extending along a length of the profile element; and a switching nub that is spatially limited is enclosed in a prechamber that is formed within the profile element, between the second side and the switch chamber, the prechamber having a length that corresponds to a length of the switch chamber;

wherein the switching nub is constructed so as to exert a spatially limited pressure that interrupts the electrically conductive contact of the contact elements in the switching strip when an external force is exerted on and deforms the profile element.

2. The closing edge safety device of claim 1, wherein the switching nub includes a plurality of switching nubs that are distributed over the length of the prechamber.

3. The closing edge safety device of claim 1, wherein the prechamber includes a plurality of prechambers provided adjacent to at least a partial circumference of the switch chamber;

wherein at least one switching nub is provided in each of at least two prechambers.

4. The closing edge safety device of claim 1, wherein the switching nub is created by a material that is injected in a flowable state into the prechamber and solidifies in the prechamber to form the switching nub.

5. The closing edge safety device of claim 4, wherein the prechamber has a through-hole there where the switching nub is to be formed.

6. The closing edge safety device of claim 5, wherein the through-hole extends through the first side of the profile element and through the switch chamber to provide a pathway into the prechamber.

7. The closing edge safety device of claim 1, wherein the switching nub is constructed as a prefabricated component and is mounted on a guide element that extends through the prechamber.

8. The closing edge safety device of claim 7, wherein the guide element extends substantially over an entire length of the prechamber.

9. The closing edge safety device of claim 8, further comprising:

end caps that close off two opposite ends of the prechamber;

wherein the guide element is fixed to the end caps, thereby fixing a position of the guide element and the switching nubs within the prechamber when the end caps are in place.

* * * * *